US005823791A

United States Patent [19]

Bellantoni et al.

[11] Patent Number: 5,823,791

[45] Date of Patent: Oct. 20, 1998

[54] CONNECTOR ASSEMBLY FOR DETACHABLY CONNECTING A PRINTED WIRING BOARD TO A COAXIAL TRANSMISSION LINES CONNECTOR

[75] Inventors: John V. Bellantoni, Redwood City; John S. Tobias, Sunnyvale, both of Calif.

[73] Assignee: Watkins-Johnson Company, Palo Alto, Calif.

[21] Appl. No.: 744,623

[22] Filed: Nov. 6, 1996

Related U.S. Application Data

[63] Continuation-in-part of Ser. No. 563,299, Nov. 28, 1995, Pat. No. 5,613,859.

[51] Int. Cl.[6] ..... H01R 9/09

[52] U.S. Cl. ..... 439/63

[58] Field of Search ..... 439/63, 581; 333/33, 333/34, 260

[56] References Cited

U.S. PATENT DOCUMENTS

| | | | |
|---|---|---|---|
| 3,292,117 | 12/1966 | Bryant et al. | 333/260 |
| 4,280,112 | 7/1981 | Eisenhart | 333/34 |
| 4,603,926 | 8/1986 | Nesbit et al. | 439/63 |
| 4,631,505 | 12/1986 | Schiavone | 333/33 |
| 4,656,441 | 4/1987 | Takahashi et al. | 333/33 |
| 4,816,791 | 3/1989 | Carnahan et al. | 333/33 |
| 4,995,815 | 2/1991 | Buchanan et al. | 439/63 |
| 5,334,050 | 8/1994 | Andrews | 439/579 |

FOREIGN PATENT DOCUMENTS

| | | | |
|---|---|---|---|
| 63-59003 | 3/1988 | Japan | 333/33 |

*Primary Examiner*—Neil Abrams
*Assistant Examiner*—Barry M. L. Standig
*Attorney, Agent, or Firm*—Flehr Hohbach Test Albritton & Herbert, LLP

[57] ABSTRACT

A connector assembly for detachably connecting a coaxial transmission line connector to a strip lead formed on a printed wiring board is disclosed. The connector assembly includes a metallic housing to house a printed wiring board circuit having a micro-strip defined by a lead on one surface of the board and a ground plane on the other surface of the board. The housing includes a low-impedance, coaxial line section formed by an opening extending through one wall of the housing and a center conductor supported in the opening by a dielectric sleeve. A connector with a lead connected to the micro-strip lead and a body with a central insulated socket spaced from a ground plane on the surface of the board forms a transmission line section. The center conductor is slidably received in the socket, whereby the coaxial connector can be easily attached to connect the printed wiring board to the coaxial transmission line.

8 Claims, 5 Drawing Sheets

CONNECTOR ASSEMBLY FOR DETACHABLY CONNECTING A PRINTED WIRING BOARD TO A COAXIAL TRANSMISSION LINES CONNECTOR

RELATED APPLICATIONS

This is a continuation-in-part of U.S. patent application Ser. No. 08/563,299 now U.S. Pat. No. 5,613,859, filed Nov. 28, 1995, titled CONNECTOR ASSEMBLY FOR DETACHABLY CONNECTING A PRINTED WIRING BOARD TO A COAXIAL TRANSMISSION LINES CONNECTOR.

FIELD OF THE INVENTION

This invention relates generally to microwave and other high-frequency communication systems, and more particularly to a connector assembly for detachably connecting coaxial transmission lines to printed wiring board circuits housed in a metallic enclosure.

BACKGROUND OF THE INVENTION

Microwave and millimeter-wave coaxial connectors are extensively employed to interconnect various components of a communications system with coaxial cable. These components are typically carried on a printed wiring board that is housed in a metallic enclosure. Connections into, and out of, said enclosure are accomplished by shielded coaxial connections, such that there is a continuous boundary of metal around the entire microwave circuitry. The coaxial connectors are fastened to the wall of the metallic enclosure. A feed-through system is used to provide communication between the coaxial connector and the printed wiring board circuit housed in the metallic enclosure.

FIGS. 1 and 2 are simplified representations of a microwave printed wiring board in an enclosure 11 with coaxial connectors 12 in accordance with the prior art. Connector 12 is an SMA type connector, however other types of coaxial connectors such as N type or BNC are also possible. A printed wiring board 14 having strip-line leads 17 interconnecting various components is carried inside the enclosure 11. The standard practice is to solder feed-through pin 18 to printed wiring board strip-line lead 17.

There are several significant disadvantages to soldering a feed-through pin to printed wiring board strip-line 17. The solder joint is rigid and brittle, thermal expansions and contractions over time lead to fatigue and eventual failure of the solder connection. Furthermore in order to remove the connector or printed wiring board for repair or replacement, the solder material needs to be removed, a process that can easily damage the printed wiring board. Both soldering and de-soldering are time consuming operations that require skilled labor.

OBJECTS AND SUMMARY OF THE INVENTION

It is an object of the present invention to provide a connector assembly for detachably connecting a coaxial connector to a printed wiring board circuit.

It is a further object of the present invention to provide a connector assembly which transitions from a coaxial line to a micro-strip configuration.

The foregoing and other objects of the invention are achieved by an assembly which includes a metallic housing to house a printed wiring board circuit having a micro-strip defined by a lead on one surface of the board and a ground plane on the other surface of the board. Said housing also includes a low-impedance, coaxial line section formed by an opening extending through one wall of the housing and a center conductor supported in said opening by a dielectric sleeve. A connector with a lead connected to said micro-strip lead and a body with a central insulated socket spaced from a ground plane on the surface of said board forms a transmission line section. Said center conductor is slidably received in said socket, whereby the coaxial connector can be easily attached to connect the printed wiring board to the coaxial transmission line.

BRIEF DESCRIPTION OF THE DRAWINGS

Additional objects and features of the invention will be more readily apparent from the following detailed description and appended claims when taken in conjunction with the drawings, wherein:

DESCRIPTION OF PREFERRED EMBODIMENT

Figure 1:
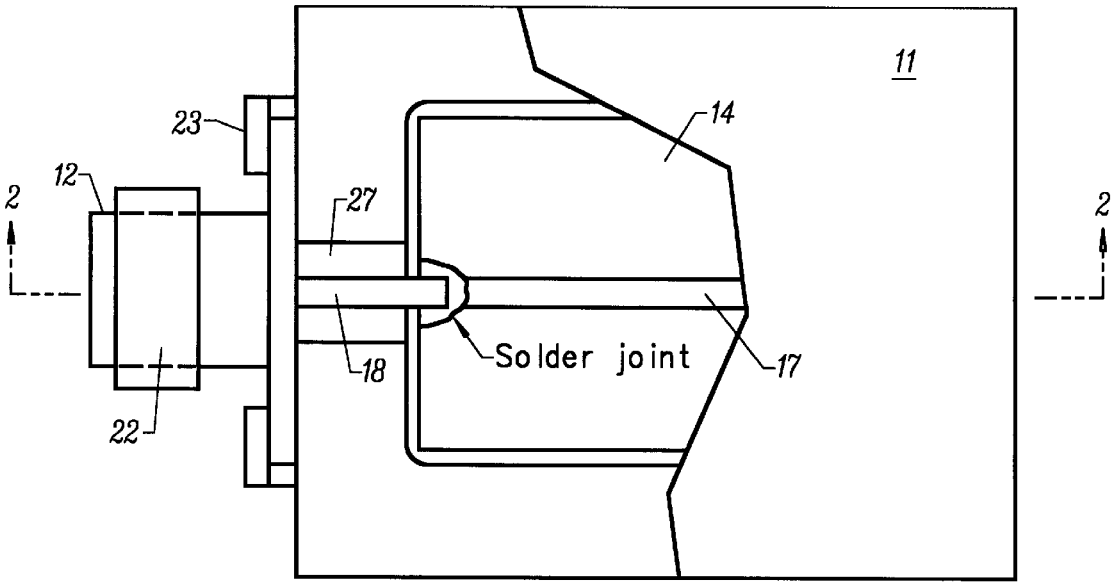
FIG. 1 PRIOR ART
FIG. 1 is a top plan view of a coaxial connector soldered to a printed wiring board micro-strip in accordance with the prior art.
Figure 2:
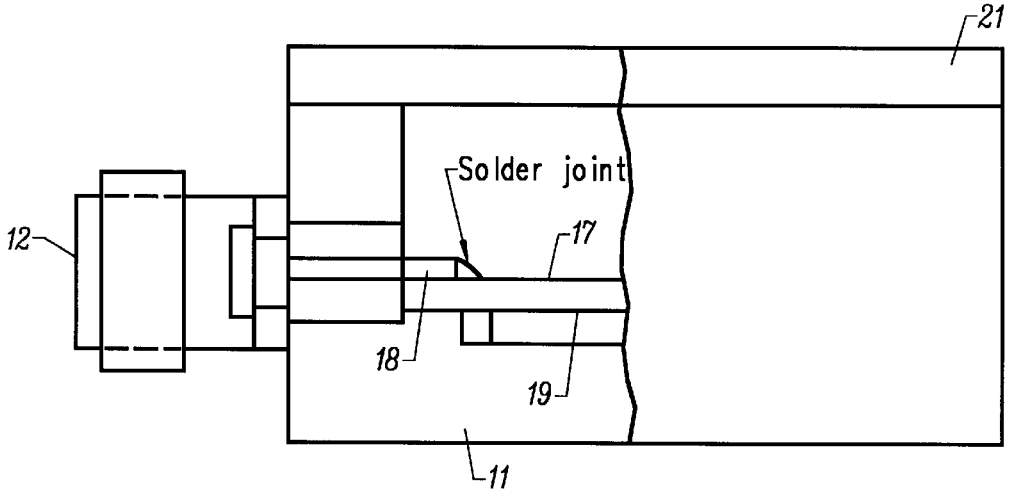
FIG. 2 PRIOR ART
FIG. 2 is a sectional view taken along line 2—2 in FIG. 1.

Referring again to FIGS. 1 and 2 the printed wiring board circuit is carried on a shelf formed on the base of enclosure 11. The printed wiring board includes a micro-strip transmission line defined by conductor 17 and conductive ground plane 19 formed on the lower surface of the printed wiring board. A cover 21 completes the housing on enclosure 11. External section 22 of a conventional coaxial connector 12 is secured to the wall of the housing by screws 23. The center conductor or pin 18 of the connector extends through aperture 27 formed in the wall of the housing and is soldered to microstrip lead 17. The impedance, generally 50 ohm, of the coaxial connector and that of the strip line are matched.

Figure 3:
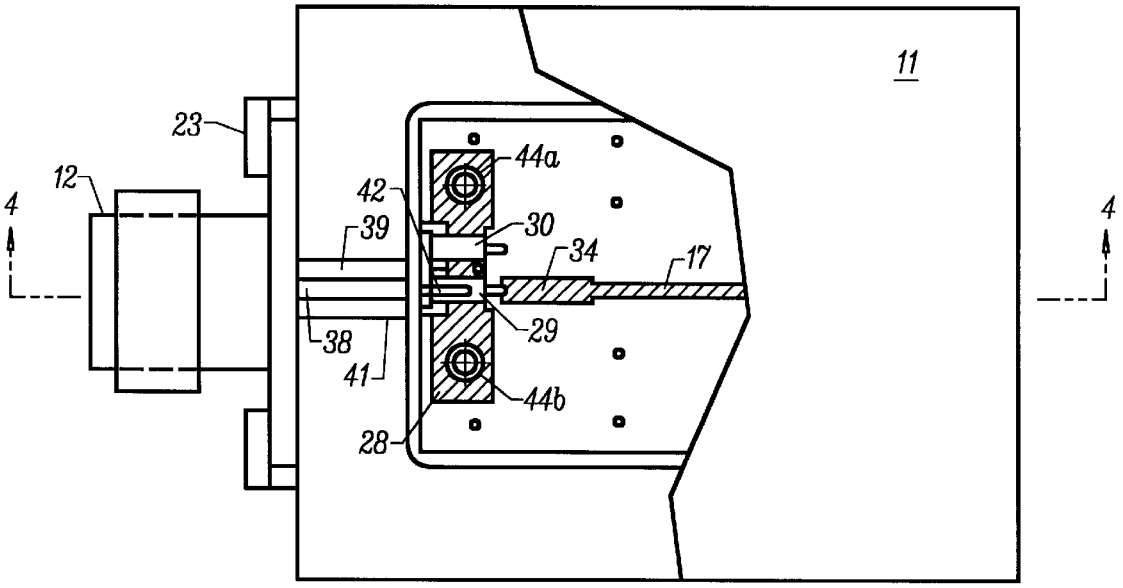
FIG. 3 is a top plan view of the preferred embodiment of the coaxial-to-printed wiring board transition of the invention.
Figure 4:
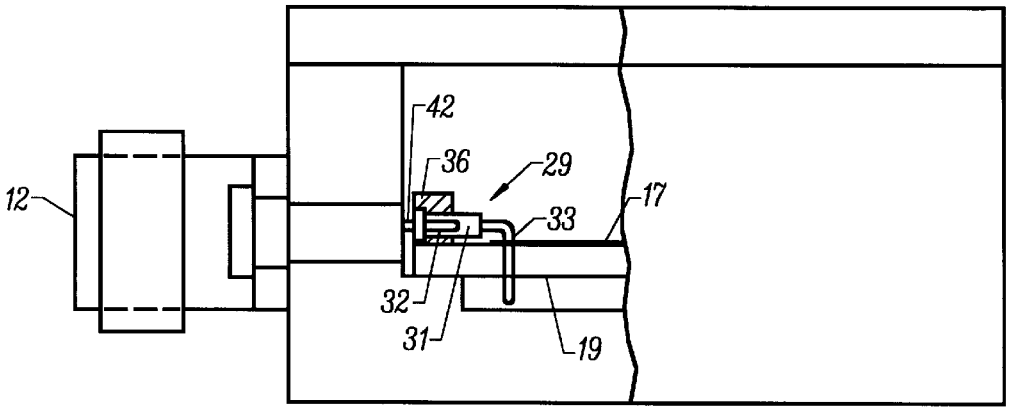
FIG. 4 is a sectional view taken along line 4—4 in FIG. 3.

Referring now to FIGS. 3 and 4, a connector assembly in accordance with the invention is described where like reference numerals have been applied to like parts. Ground plane 19 of the printed wiring board is connected through vias 44*a* and 44*b* to a ground plane section 28 formed on its upper surface. Connector assembly 29 includes a metal body 31 having a socket or well 32 and a right angle pin 33 which is connected to micro-strip lead 17. Lead 17 includes an enlarged section 34 which provides a matching impedance. Body 31 includes an insulating sleeve 36 which spaces the body from ground plane section 28 to form a transmission line section. In the present embodiment, a second connector 30, identical to connector 29, is attached to and soldered with connector 29 to the printed wiring board to prevent connector 29 from rotating during assembly. The center lead of the coaxial connector is connected to a coaxial transmission line section formed by center conductor 38 supported by a dielectric sleeve 39 in opening 41 formed in the housing. The dielectric sleeve diameter is reduced to provide a lower impedance. A lead 42 extends outwardly from center conductor 38 and is slidably received in socket 32 of connector assembly 29.

The connector assembly of the invention provides operation over a wide frequency range up to 3.8 GHz. The wide frequency range of the present invention is accomplished by the small diameter of insulating sleeve 36 of the connector and adding a low impedance matching section on the printed wiring board directly after the right angle header. These two elements in conjunction serve to tune out the highly inductive effect associated with the right angle header. Said inductance associated with the right angle header is minimized by bringing ground 28 up to the surface of the printed wiring board with a plurality of plated-through vias 44*a* and 44*b*.

Figure 5:
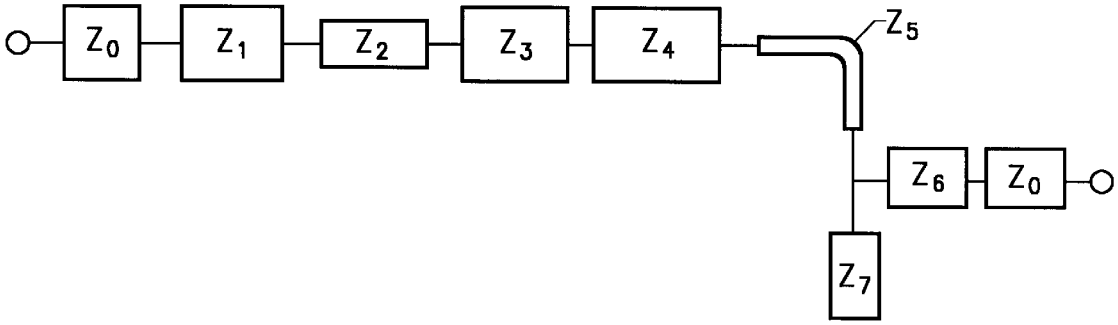
FIG. 5 is an equivalent electrical circuit showing impedance characteristics of the transition from coaxial transmission line to printed wiring board of the invention depicted in FIGS. 3 and 4.

Referring to FIG. 5 where the blocks represent impedance, $Z_0$ represents the impedance of the coaxial line, $Z_1$, the decreased impedance at the feed-through, $Z_2$ and $Z_3$ the impedance of lead 42 with respect to the housing and with respect to the printed wiring board ground plane, $Z_4$ the header impedance, $Z_5$ the impedance of the right angle header, $Z_6$ the enlarged micro-strip section impedance, $Z_7$ the impedance between the bent header end and housing and $Z_0$ the same impedance as the input. Thus, the input coaxial impedance $Z_0$ matches the micro-strip impedance $Z_0$.

Alternate Embodiments

Figure 6:
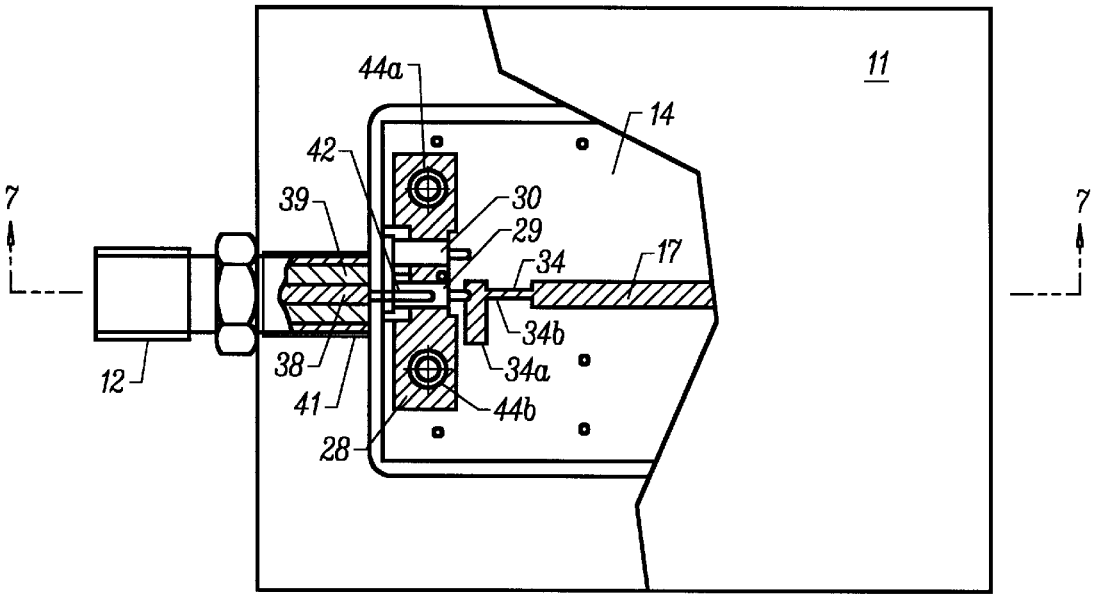
FIG. 6 is a top plan view of another embodiment of the present invention for is detachably connecting a SMA spark-plug type connector to a printed wiring board.
Figure 7:
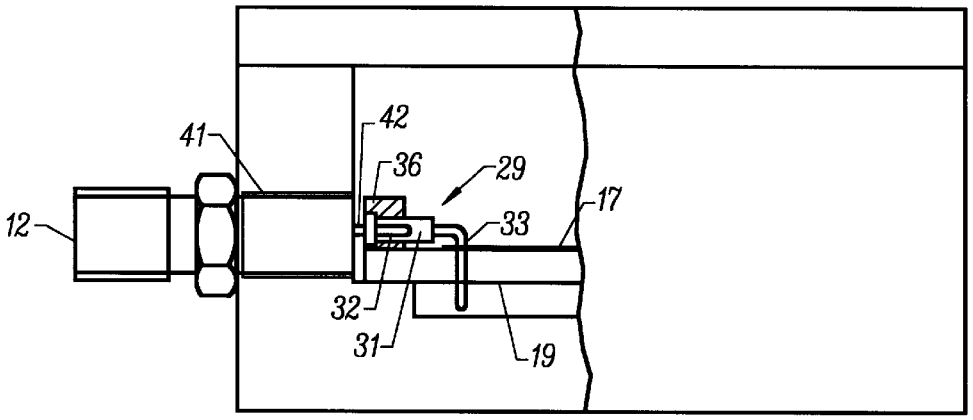
FIG. 7 is a sectional view taken along line 7—7 in FIG. 6.

Those skilled in the art will recognize that the connector assembly described above can be used to detachably connect a printed wiring board to a variety of coaxial connectors including SMA type connectors, N type connectors, BNC type connectors, or spark-plug type connectors. FIGS. 6 and 7 depict an embodiment of the present invention used to detachably connect a printed wiring board to a SMA spark-plug type thread-in connector.

As depicted in FIGS. 6 and 7, connector 12 represents a SMA spark-plug type thread-in connector connected to printed wiring board 14 via the connector assembly invention. Such spark-plug type connectors are well known in the art and available as off the shelf components. As previously described, ground plane 19 of the printed wiring board is connected through vias to ground plane section 28 formed on its upper surface. Connector assembly 29 includes a metal body 31 having a socket 32 and a right angle pin 33 which is connected to micro-strip lead 17 of printed wiring board 14. However, in this embodiment, unlike the embodiment depicted in FIGS. 3 and 4, micro-strip lead 17 includes an matching section 34 comprising two elements—a first part 34*a* having a low impedance shunt stub and a second part 34*b* having a high impedance line the low and high impedance being in relation to the characteristic impedance of the system. These two elements provide for impedance matching between the impedance of the spark-pug type connector and the micro-strip lead impedance. Body 31 also includes an insulating sleeve 36 which spaces the body from ground plane section 28 to form a transmission line section. A second connector assembly 30, identical to connector assembly 29, is soldered to connector assembly 29 and attached to the printed wiring board to prevent the rotational motion of connector assembly 29 during assembly. The center lead of the SMA coaxial connector is a 50 ohm transmission line section formed by center conductor 38 supported in dielectric sleeve 39. Lead 42 extends outwardly from center conductor 38 and is slidably received in socket 32 of connector assembly 29.

The connector assembly depicted in FIGS. 6 and 7 provides operation over a wide frequency range up to 3.5 GHz. This wide frequency range is made possible by the two elements 34*a* and 34*b* of impedance matching section 34 placed on the printed wiring board directly after the right angle header. These two elements in conjunction serve to tune out the highly inductive effect associated with the right angle header. The inductance associated with right angle header is further minimized by bringing ground 28 up to the surface of the printed wiring board with a plurality of plated-through vias.

Figure 8:
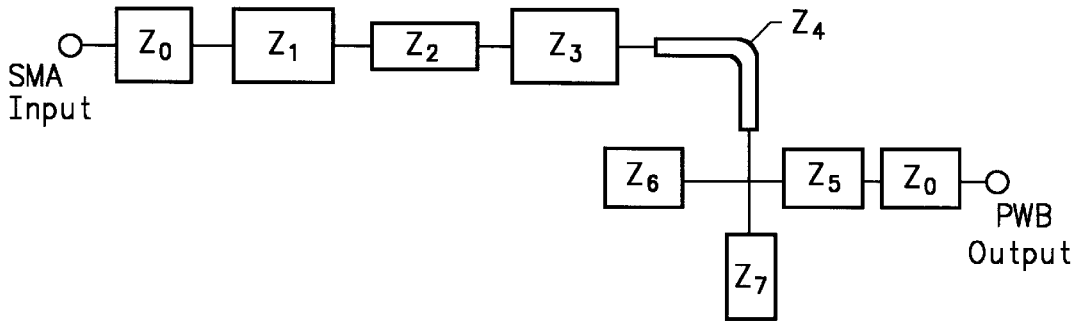
FIG. 8 is an equivalent electrical circuit showing impedance characteristics of the configuration depicted in FIGS. 6 and 7.

FIG. 8 depicts that impedances of the various components depicted in FIGS. 6 and 7. $Z_0$ represents the impedance of the SMA coaxial connector, $Z_1$, and $Z_2$. the impedance of lead 42 with respect to the housing and with respect to the printed wiring board ground plane, $Z_3$ the header impedance, $Z_4$ the impedance of the right angle header, $Z_5$ the reduced micro-strip matching section impedance, $Z_6$ the enlarged micro-strip matching section impedance, $Z_7$. the impedance between the bent header end and housing, and $Z_0$ the same impedance as the input. Thus, the input coaxial impedance $Z_0$ matches the impedance of the SMA coaxial connector $Z_0$.

Thus there has been provided an interconnection assembly that allows field replaceable mounting of a printed circuit wiring board circuit in a metallic housing.

The foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed:

1. A connector assembly for detachably connecting a printed wiring board to a threaded coaxial connector having a coaxial center lead, said connector assembly comprising:

a coaxial transmission line section comprising a center conductor connected to said coaxial center lead of said coaxial connector, said center conductor supported in a dielectric sleeve;

a first socket to slidably receive said center conductor;

a right angle pin connected to said socket;

a transmission line lead carried on a surface of said printed wiring board, said transmission line connected to said right angle pin and having impedance matching sections for providing impedance matching between the coaxial connector and the transmission line lead;

a ground plane section carried on said printed wiring board; and an insulating sleeve surrounding said first socket whereby said first socket forms a transmission line with said ground plane section.

2. The connector assembly of claim 1 wherein said transmission line lead comprises:

a first section having low impedance relative to the characteristic impedance; and a second section having high impedance relative to the characteristic impedance.

3. The connector assembly of claim 1, wherein said first socket, said right angle pin, said transmission line lead, said ground plane section and said insulating sleeve are configured to match impedance of said coaxial connector and said transmission line section.

4. The connector assembly of claim 2 wherein said first section and said second section tune out inductive effects associated with said right angle pin.

5. The connector assembly of claim 1 wherein said coaxial connector is a spark-plug connector.

6. The connector assembly of claim 1 wherein said transmission line lead is a micro-strip lead.

7. The connector assembly of claim 1 further comprising a second socket connected to said first socket and to said printed wiring board to prevent rotation of said first socket.

8. The connector assembly of claim 1 wherein said connector assembly supports a frequency operation range of up to 3.8 GHz.

* * * * *